United States Patent [19]

Sylvester

[11] 4,148,652

[45] Apr. 10, 1979

[54] INSTANT PROCESSING FILM UNIT

[75] Inventor: Robert A. Sylvester, Parma, N.Y.

[73] Assignee: Eastman Kodak Company, Rochester, N.Y.

[21] Appl. No.: 834,617

[22] Filed: Sep. 19, 1977

[51] Int. Cl.[2] ..... G03C 1/48; G03D 9/02

[52] U.S. Cl. ..... 96/76 C; 354/304

[58] Field of Search ..... 96/67, 76 R, 76 C; 354/304

[56] References Cited

U.S. PATENT DOCUMENTS

| | | | |
|---|---|---|---|
| 406,085 | 7/1889 | Carlisle | 354/174 |
| 2,472,358 | 6/1949 | Wolff | 96/76 C |
| 2,740,714 | 6/1951 | Bachelder | 96/76 C |
| 3,854,812 | 12/1974 | Sorli | 354/312 |
| 3,963,496 | 6/1976 | Arisaka | 96/76 C |

*Primary Examiner*—Richard L. Schilling
*Attorney, Agent, or Firm*—J. A. Matthews

[57] ABSTRACT

An instant-processing film unit of the preregistered type is adapted for use in commercially available adapters for professional type cameras. The film unit includes a photosensitive element for recording a processable latent image, a cover sheet for facilitating the distribution of a processing composition over the element, and an internal dark slide removably positioned between the photosensitive element and cover sheet for shielding one side of the element from premature exposure. The dark slide extends from between the photosensitive element and cover sheet through an opening at one end of the film unit, and is provided with an opaque hood which is attached to the dark slide and encloses the opening to protect such end from light leaks.

14 Claims, 12 Drawing Figures

FIG. 1
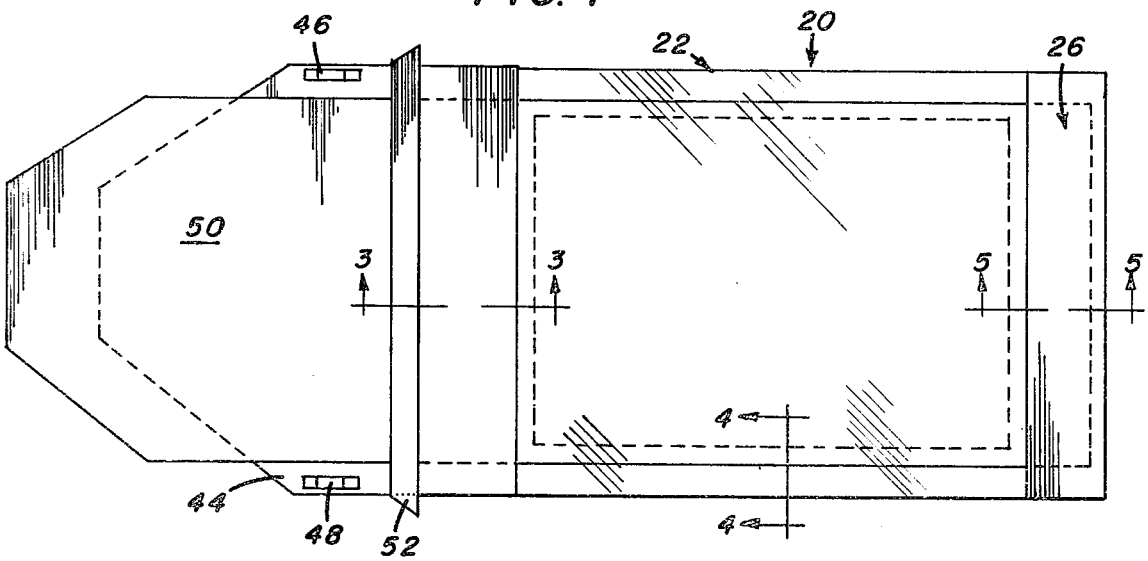
FIG. 2
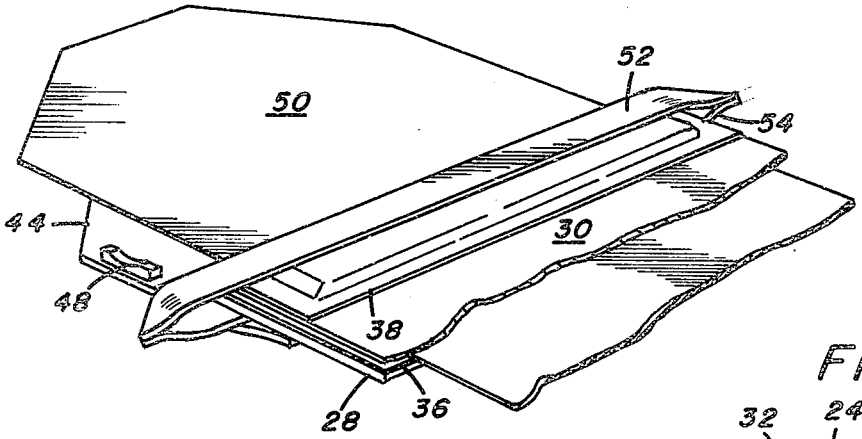
FIG. 3
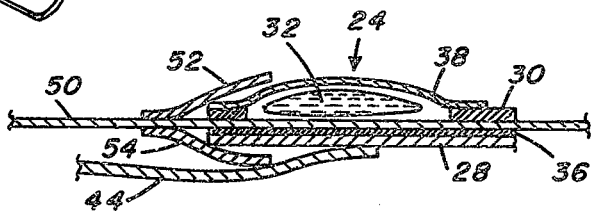
FIG. 4
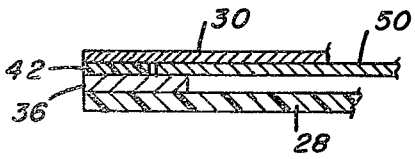
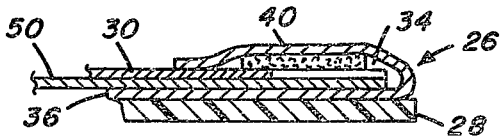
FIG. 5

38
34
30
42
32
42
50
52
54
40
28
36
46
48
44

INSTANT PROCESSING FILM UNIT

CROSS-REFERENCE TO RELATED APPLICATIONS

Reference is made to commonly assigned, copending U.S. Pat. Applications Ser. No. 834,589 entitled INSTANT PROCESSING FILM UNIT HAVING INTERNAL DARK SLIDE, filed on even date herewith in the name of Wayne A. Bubb and Ser. No. 572,541 entitled INTEGRAL FILM UNIT, filed on Apr. 28, 1975 in the names of F. F. Tone and R. J. Borel (now U.S. Pat. No. 4,042,395, issued on Aug. 16, 1977).

BACKGROUND OF THE INVENTION

1. Field of the Invention

The present invention relates generally to photographic film units of the instant-processing type that can be handled in daylight without fogging or premature exposure because of a removable, opaque sheet which shields the photosensitive elements of the film unit from actinic or other radiation. The opaque sheet extends from within the film unit through an opening at one end of the unit, and is removed prior to making an exposure. More specifically, the invention relates to means for establishing a light seal between the opaque sheet and the interior of the film unit.

2. Background of the Prior Art

A preregistered instant processing film unit that is suitable for daylight handling is disclosed in coassigned U.S. Pat. Application Ser. No. 834,589, filed concurrently herewith and entitled INSTANT PROCESSING FILM UNIT HAVING INTERNAL DARK SLIDE. That film unit includes a photosensitive element for recording a latent image that is processable to establish a visible image, a transparent cover sheet for facilitating the distribution of a processing composition over the photosensitive element to effect such processing of the element, a reservoir for supplying the composition and an opaque sheet removably positioned between the photosensitive element and the cover sheet to protect the photosensitive element from premature exposure by radiation entering through the cover sheet. The film unit may be positioned in suitable exposure apparatus with the opaque sheet extending to a position where it is accessible for removal from between the photosensitive element and cover sheet before an exposure is made. While the exposure apparatus may take various forms, the preferred embodiment of the film unit of the present invention has particular utility in presently available professional cameras or adapters for such cameras.

In the above-identified, coassigned application, the opaque sheet is identified as an internal dark slide, and that term will also be used hereout. Under adverse handling conditions when the photosensitive element and the cover sheet may be forced apart, light may leak into the unit at the opening through which the dark slide extends from between the photosensitive element and the cover sheet. The dark slide of the coassigned application cooperates with the film unit to form a light seal which has particular advantages and generally operates satisfactorily for its intended purpose. However, under unusual operating conditions, it may suffer from certain disadvantages.

SUMMARY OF THE INVENTION

By the present invention, I have provided a novel light seal for photographic film units of the type described, wherein an internal dark slide extends through an opening between the cover sheet and the photosensitive element to a position outside of the film unit, where it is accessible by the operator. The dark slide carries an opaque hood which extends from the dark slide over the cover sheet, and from the dark slide over the photosensitive element so as to prevent light from entering the film unit through the opening out of which the dark slide extends.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings in which:

FIG. 1 is a plan view of a film unit in accordance with the preferred embodiment of the invention depicting its general features including the dark slide and leader;

FIG. 2 is a partial perspective view of the film unit of FIG. 1;

FIGS. 3–5 are cross-sectional views of the film unit of FIG. 1 taken as identified in FIG. 1 and illustrating internal features at the ends and edges of the film unit;

DESCRIPTION OF THE PREFERRED EMBODIMENT

Figure 6:
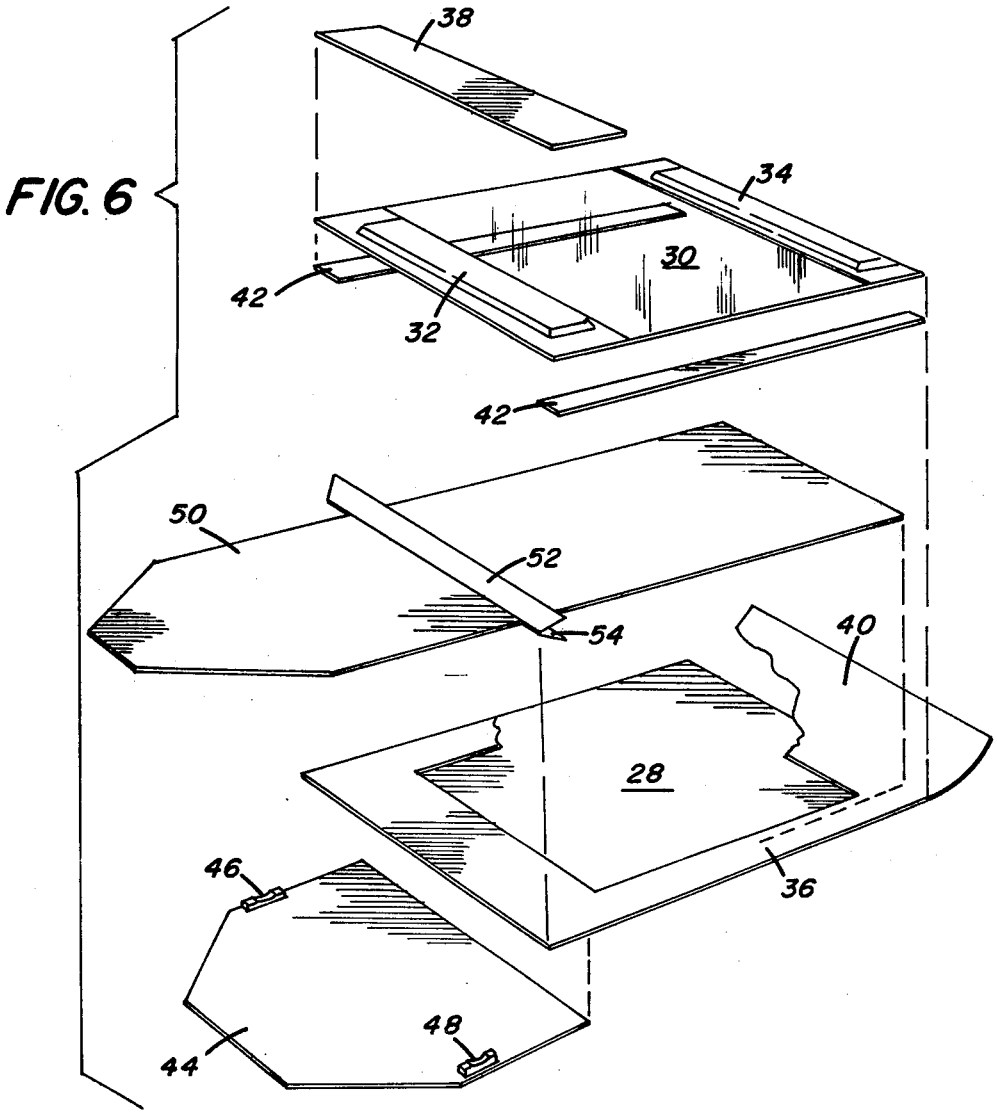
FIG. 6 is an exploded view of the film unit of FIG. 1.
Figure 7:
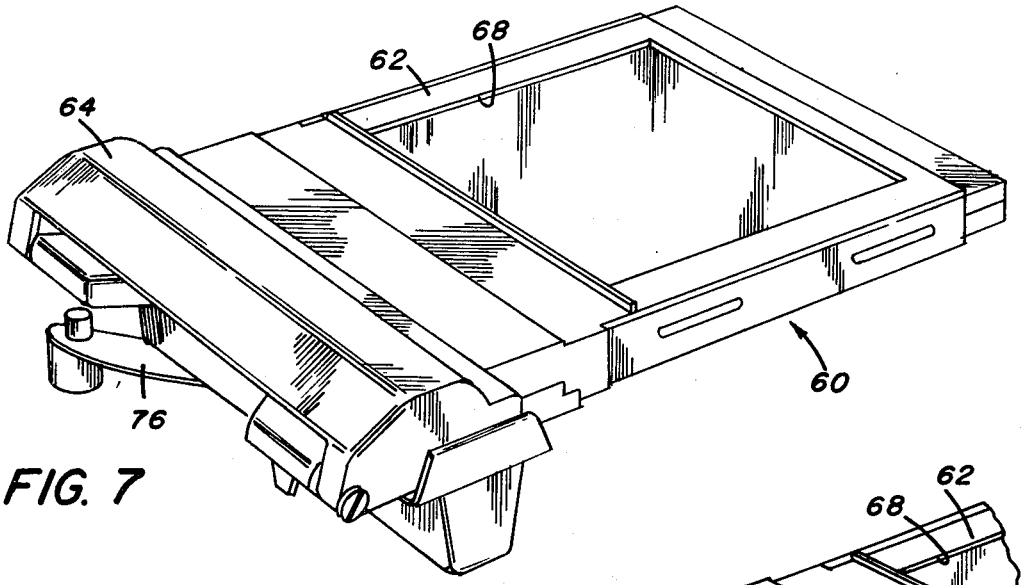
FIG. 7 is a perspective view of known apparatus in which the film unit of FIG. 1 is suitable for use.

Referring now to the drawings, and especially to FIGS. 1–5, a self processing film unit assembly 20 is depicted in accordance with a preferred embodiment of the present invention. The film unit assembly includes an image recording unit 22, processing composition supply means 24 and excess composition receiving means 26. The picture unit is adapted to record a latent image that is processable by a fluid in supply means 24, and for this purpose, is provided with a photosensitive element 28 and a transparent cover sheet 30 for aiding in distributing the fluid over the photosensitive element.

These elements are well known in the prior art, as in the preregistered integral film unit described in U.S. Pat. Application Ser. No. 572,541 entitled INTEGRAL FILM UNIT, filed Apr. 28, 1975 in the names of F. F. Tone and R. J. Borel (now U.S. Pat. No. 4,042,395, issued on Aug. 16, 1977). As disclosed in that application, photosensitive element 28 includes one or more radiation sensitive layers for recording a latent image, an opaque layer below (as viewed in FIG. 3) the photosensitive layers and a mordant below the opaque layer for receiving a visible image that is established during processing of the latent image. Below the mordant, there is a transparent support layer. These and additional respective layers of the photosensitive element are known in the prior art and will not be described in detail. It should be recognized, however, that the radiation sensitive layers are shielded from actinic or other radiation striking the bottom face of the picture unit.

Processing composition supply means 24 and receiving means 26 includes a chemical pod or pouch 32 and trap 34, respectively, disposed at the leading and trailing end sections of the picture unit. The pouch is provided for supplying the processing composition for distribution between the photosensitive element and cover sheet while the trap collects any excess of the composition from between the photosensitive element and the cover sheet.

It is desirable that the final print formed in the image receiving layer have precisely established edges. For this purpose an opaque mask 36 (best viewed in FIG. 6) extends along the end sections and lateral margins of the picture unit to create an image frame which defines the perimeter of the final picture area. The mask may be of the internal type, adhered to the photosensitive element between that element and the cover sheet. The mask also may be used for covering the pod and trap such as by cutting a piece 38 for placement over the pod and by folding another section 40 around the trap and cover sheet. In such case, the mask helps block light from entering between the photosensitive element and the cover sheet at the leading and trailing ends of the picture unit. The mask is of precisely known caliper for spacing the photosensitive element and cover sheet during distribution of the processing composition to establish the desired thickness of the distributed composition. On top of mask 36, a pair of opaque side rails 42 (FIGS. 4 and 6) cooperate with the mask to secure, with appropriate adhesives, the cover sheet to the photosensitive element. The combined mask and side rails also prevent light from entering between the photosensitive element and the cover sheet at the lateral margins of the picture unit.

A flexible but somewhat stiff leader 44 overlaps with and is attached to the photosensitive element near the element's leading edge to facilitate handling of the film unit in cooperating apparatus as described more fully hereinafter. Saddle detents or shims 46 and 48 are provided at the lateral edges of the leader for similar purposes.

It will be noted that, within the bounds of mask 36, photosensitive layer 28 is overlayed only by transparent cover sheet 30. Therefore, should light fall upon the cover sheet, it will pass therethrough to expose the photosensitive layer and form a latent image. Of course, this normally prevents handling of the film unit assembly in lighted conditions unless adequate, light-tight arrangements are made.

To this end, I have provided an opaque sheet, or dark slide 50 which is positioned between photosensitive element 28 and cover sheet 30 in the space provided by opaque side rails 42. The dark slide has a length which is sufficient to extend from the trailing end section of the picture unit (FIG. 5), through an opening at the leading end of the picture unit and preferably beyond the end of leader 44. The dark slide, when in position between the photosensitive element and the cover sheet, lies over the entire image frame and extends to overlap mask 36 around the entire perimeter of the final-image area. Moreover, as depicted most clearly in FIG. 4, the caliper of the dark slide is chosen to fit between mask 36 and cover 30 in the space provided by spacer rails 42 such that sufficient contact is maintained to provide an adequate light seal.

However, at the leading end section of the picture unit, where the dark slide exits from between mask 36 and the cover sheet (FIG. 3), additional light sealing means are desirable to prevent light from entering the film unit during certain conditions. Accordingly, I have provided a pair of opaque flaps 52 and 54 which are adhered to the dark slide and overlap the leading end of image recording unit 22 when the dark slide is in place. Lower flap 54 fits between photosensitive element 28 and leader 44 to form, with upper flap 52, a hood completely covering the opening through which the dark slide extends into the interior of the image recording unit. The outer edges of flaps 52 and 54 are sealed to each other as best seen in FIG. 2.

Figure 8:
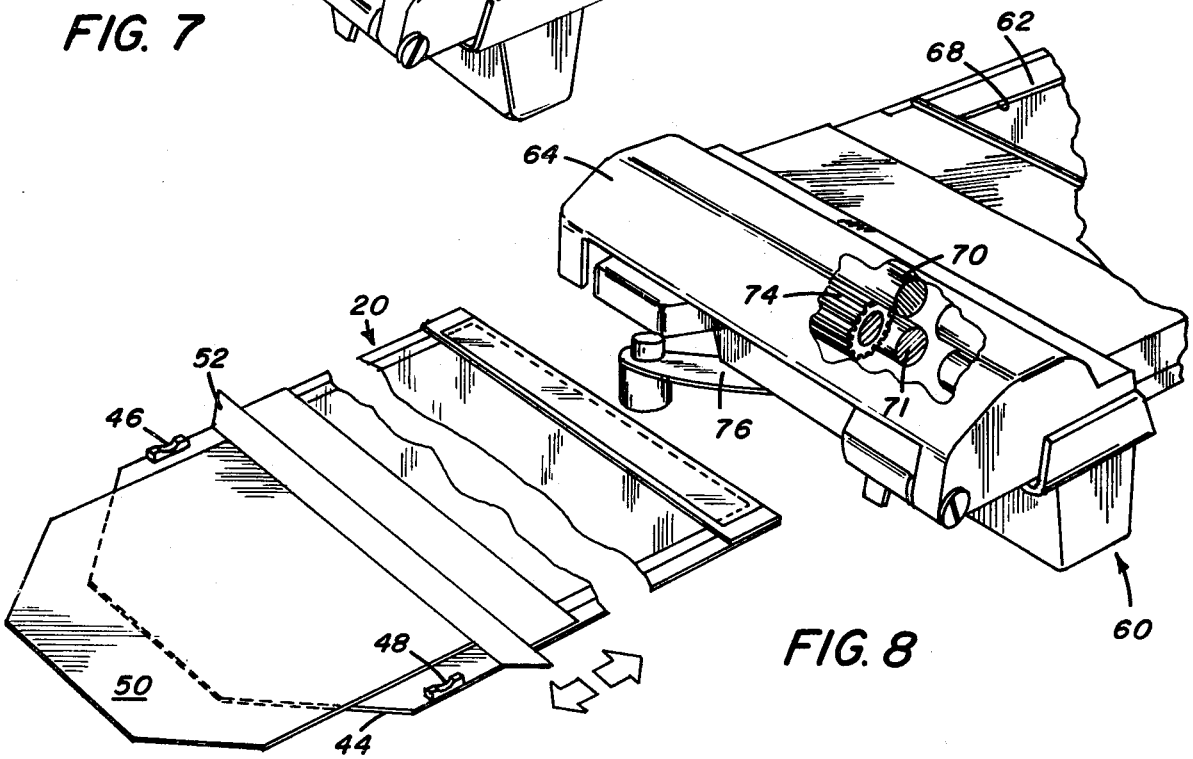
FIGS. 8–12 are partial perspective and front elevational views depicting the method of operation of the film unit of FIG. 7.
Figure 9:
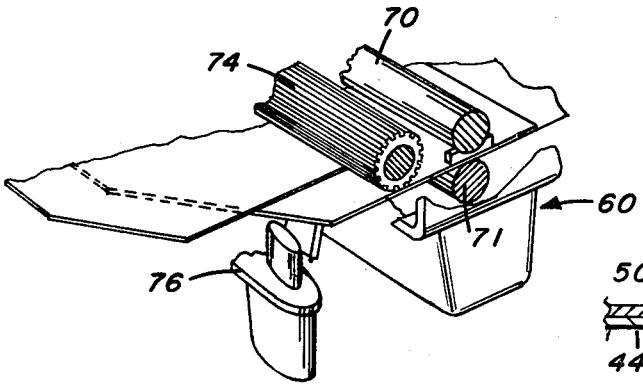

While the film unit according to the present invention is useable in various types of exposure apparatus, its operation will be explained herein with reference to FIGS. 7–12 and a particular, commercially available camera-back adapter 60 of a type including a body portion 62 and a processing section 64. Body portion 62 defines a cavity for receiving individual ones of the film unit assemblies and an exposure aperture 68 through which film unit assemblies in the cavity may be exposed. Processing section 64 includes a pair of pressure applying members 70 and 71 and a passageway which is defined in part by a light blocking rubber roller 74. A latch handle 76 partially shown in FIGS. 8 and 9 is movable from an open or loading position (FIGS. 7 and 8) where the pressure applying members are spaced-apart to a closed or processing position (FIGS. 9 and 10) where the members are urged together for initiating processing.

Figure 10:
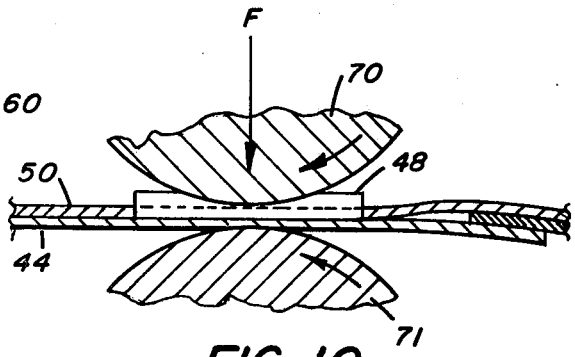
Figure 11:
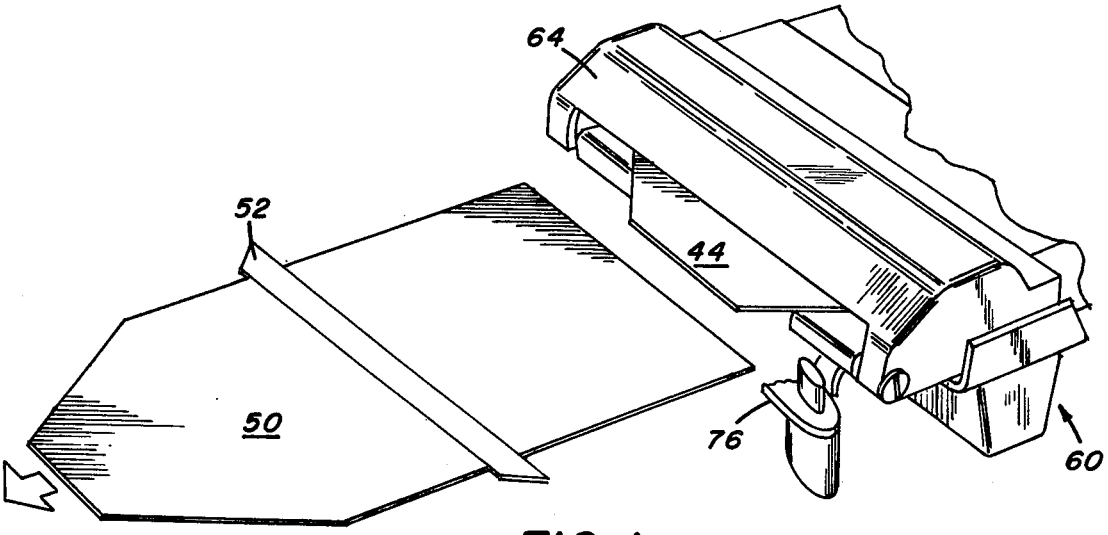
Figure 12:
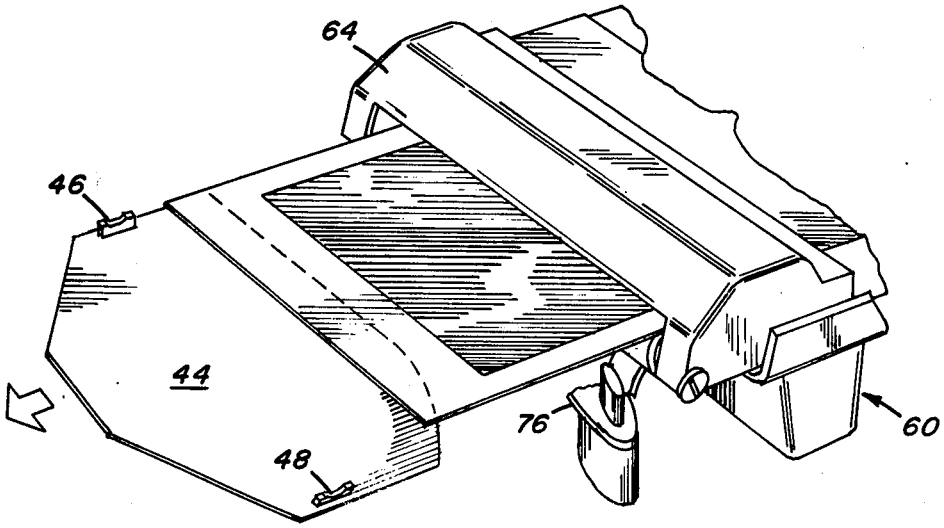

In operation, and referring first to FIG. 8, the latch handle 76 is moved to its open position, the film unit assembly, protected by the inserted dark slide, is inserted under roller 74 and between the pressure applying members into the cavity below aperture 68. Suitable means, not shown, support the film unit in a substantially flat condition suitable for exposure. Latch handle 76 is then closed to release pressure member 70 to drop onto arcuate sections of detents 46 and 48 to hold the film unit in its proper operative position (FIG. 10). The detents also may act as lifters to relieve some of the pressure of the members 70, 71 from the dark slide.

The dark slide is then removed in preparation for an exposure by grasping its leading end and pulling the slide (FIG. 10) entirely from the film unit and apparatus. It will be noted that the leading end of dark slide 50 extends beyond leader 44 so that the operator will more naturally tend to grasp the dark slide than the leader. Removal of the dark slide uncovers the photosensitive element and its sensitive layers for exposure through aperture 68 of the apparatus and the transparent cover sheet of the film unit assembly.

After exposure of the film unit, leader 44, uncovered by removal of the dark slide, is pulled (FIG. 12) to initiate processing in a known manner and to remove the film unit from the apparatus. This distributes the processing composition from the pod to the space between the photosensitive element and cover sheet. Assuming the composition includes an opacifier, as is common in integral film units, distribution of the composition establishes another opaque layer which cooperates with the first opaque layer in photosensitive element 28 to shield the film unit from further exposure and to permit daylight processing. During processing imagewise distributions of dyes diffuse through the opaque layer of the photosensitive element to that element's mordant, where the transferred image is visible from below the picture unit as depicted in FIG. 3. Finally, if desired, the leader can be stripped from the picture unit as in FIG. 12. The picture unit then becomes the final print.

Although the invention has been described with particular reference to a preferred embodiment thereof, it will be readily understood that variations and modifications can be effected within the spirit and scope of the invention as described hereinabove and as defined in the appended claims.

I claim:

1. In an instant-processing film unit of the preregistered type including a reservoir for liquid processing composition, a photosensitive element for recording a latent image processable by the composition to establish a visible image, and a transparent cover sheet coupled to the photosensitive element for facilitating the distribution of the processing composition from the reservoir onto the photosensitive element, said photosensitive element including an opaque layer and at least one light-sensitive layer between the opaque layer and the cover sheet; the improvement comprising:

means defining an opening in one end of the film unit for providing access between the photosensitive element and the cover sheet;

an opaque dark slide between the photosensitive element and the cover sheet shielding the photosensitive element from fogging by light passing through the cover sheet, said dark slide extending through said opening to a position accessible for removing the dark slide from between the element and sheet; and light sealing means carried by said dark slide and defining a hood enclosing both the photosensitive element and the cover sheet at said one end for blocking light from entering through said opening to prevent fogging of said photosensitive element.

2. The invention as defined in claim 1 wherein said light-sealing means comprises first and second opaque flaps attached to said dark slide and extending respectively over at least a portion of the cover sheet and the photosensitive element.

3. The invention as defined in claim 2 wherein:

said dark slide has a leading edge, a trailing edge and two lateral edges; and said flaps extend beyond said lateral edges of said dark slide whereat they are joined together.

4. The invention as defined in claim 2 wherein said flaps are attached to said dark slide externally of the photosensitive element and cover sheet.

5. The invention as defined in claim 1 further comprising:

a leader extending from the film unit generally parallel with said dark slide, said dark slide extending beyond said leader.

6. The invention as defined in claim 5 wherein said leader is releasably attached to said film unit.

7. The invention as defined in claim 1 further comprising a pair of spaced apart rails extending between the photosensitive layer and the cover sheet on opposite sides of said dark slide.

8. The invention as defined in claim 7 wherein said rails are at least as thick as the thickness of said dark slide.

9. In an instant-processing film unit including a reservoir for processing composition, a photosensitive element for recording a latent image processable by the composition to establish a visible image, and a transparent cover sheet coupled to the photosensitive element so as to define a cavity therebetween for facilitating the distribution of the processing composition over the photosensitive element, the photosensitive element including an opaque layer and at least one light-sensitive layer between said opaque layer the cover sheet; the improvement comprising:

an opaque dark slide removably positioned between the photosensitive element and the cover sheet, said slide overlying the photosensitive element to shield the photosensitive element from light passing through the cover sheet, and projecting from between the photosensitive element and cover sheet to facilitate removal of the dark slide; and an opaque hood carried by said dark slide and extending to enclose both the photosensitive element and the cover sheet where said dark slide projects from therebetween for shielding the photosensitive element from fogging by light entering between photosensitive element and cover sheet adjacent said dark slide.

10. The invention as defined in claim 9 wherein said light-sealing means comprises first and second opaque flaps attached to said dark slide and extending respectively over at least a portion of the cover sheet and the photosensitive element.

11. The invention as defined in claim 9 further comprising:

a leader extending from the film unit parallel to the dark slide, said dark slide extending beyond said leader.

12. The invention as defined in claim 11 wherein said leader is releasably attached to said film unit.

13. The invention as defined in claim 9 further comprising a pair of spaced apart rails attached to the photosensitive element and the cover sheet on opposite sides of said dark slide.

14. The invention as defined in claim 13 wherein said rails are at least as thick as the thickness of said dark slide.

* * * * *